US012655851B2

(12) United States Patent
Tallgren et al.

(10) Patent No.: US 12,655,851 B2
(45) Date of Patent: Jun. 16, 2026

(54) CENTRIFUGAL FAN OR COMPRESSOR COMPOSITE IMPELLER WITH ABRASION RESISTANCE

(71) Applicant: Howden Turbo GmbH, Frankenthal (DE)

(72) Inventors: Joni Tallgren, Klaukkala (FI); Jason Stoklosa, West Seneca, NY (US)

(73) Assignee: HOWDEN TURBO GMBH, Frankenthal (DE)

( * ) Notice: Subject to any disclaimer, the term of this patent is extended or adjusted under 35 U.S.C. 154(b) by 0 days.

(21) Appl. No.: 18/950,327

(22) Filed: Nov. 18, 2024

(65) Prior Publication Data

US 2026/0139684 A1 May 21, 2026

(51) Int. Cl.
*F04D 29/28* (2006.01)
*F04D 29/02* (2006.01)

(52) U.S. Cl.
CPC ..... *F04D 29/282* (2013.01); *F04D 29/023* (2013.01); *F04D 29/289* (2013.01)

(58) Field of Classification Search
CPC ..... F04D 29/289
See application file for complete search history.

(56) References Cited

U.S. PATENT DOCUMENTS

| | | | |
|---|---|---|---|
| 3,115,097 | A | 12/1963 | Zagar et al. |
| 3,608,976 | A | 9/1971 | Zugelder et al. |
| 4,052,133 | A | 10/1977 | Yeater |
| 4,428,717 | A | 1/1984 | Catterfeld |
| 6,264,430 | B1 | 7/2001 | Hulkkonen et al. |
| 6,402,467 | B1 | 6/2002 | Godichon et al. |
| 6,976,828 | B2 | 12/2005 | Godichon et al. |
| 7,780,420 | B1 | 8/2010 | Matheny |
| 8,342,809 | B2 | 1/2013 | Hezari et al. |
| 8,827,654 | B2 | 9/2014 | Schreiber et al. |
| 9,410,438 | B2 | 8/2016 | Yu |
| 9,909,553 | B2 | 3/2018 | Skare |
| 10,426,085 | B2 | 10/2019 | Cavkusic et al. |

(Continued)

FOREIGN PATENT DOCUMENTS

| | | | |
|---|---|---|---|
| DE | 4318224 | A1 | 12/1994 |
| DE | 102009001095 | A1 | 8/2010 |

(Continued)

OTHER PUBLICATIONS

Notification of Transmittal of International Search Report and Written Opinion, including International Search Report for International Application No. PCT/IB2025/060721 mailed Jan. 28, 2026, 12 pages.

*Primary Examiner* — Courtney D Heinle
*Assistant Examiner* — John S Hunter, Jr.
(74) *Attorney, Agent, or Firm* — Edell, Shapiro & Finnan, LLC

(57) ABSTRACT

A fan impeller made of complex three dimensional composite structures which results in the combination of mechanical properties and abrasion and erosion resistance which allows for improved utility, functionality, reliability, cost, and safety for the user. The specific composite structures vary based on fan size and design as well as the gas and application requirements relative to such as but not limited to temperature, corrosivity, abrasiveness, etc., and may include but are not limited to combinations of fibers, resins, 3D printed reinforcement structures, cast reinforcement structures, and/or fabricated reinforcement structures.

20 Claims, 13 Drawing Sheets

(56) References Cited

U.S. PATENT DOCUMENTS

| | | | |
|---|---|---|---|
| 10,494,933 | B2 | 12/2019 | Bryant, Jr. et al. |
| 10,598,186 | B2 | 3/2020 | Cappuccini et al. |
| 10,815,797 | B2 | 10/2020 | Karlen et al. |
| 10,907,483 | B2 | 2/2021 | Okuda et al. |
| 10,914,175 | B2 | 2/2021 | Okabe et al. |
| 10,914,183 | B2 | 2/2021 | Rustad et al. |
| 10,934,847 | B2 | 3/2021 | Danno et al. |
| 10,934,851 | B2 | 3/2021 | Guivarc'h et al. |
| 10,982,556 | B2 | 4/2021 | Kitamura |
| 11,105,210 | B2 | 8/2021 | Gimat et al. |
| 11,162,505 | B2 | 11/2021 | Bellaci et al. |
| 11,286,776 | B2 | 3/2022 | Charlas |
| 11,333,028 | B2 | 5/2022 | Congratel et al. |
| 11,396,844 | B2 | 7/2022 | Mizuno et al. |
| 11,560,798 | B2 | 1/2023 | Churcher et al. |
| 11,572,796 | B2 | 2/2023 | Theertham et al. |
| 2009/0095436 | A1 | 4/2009 | Pessin et al. |
| 2010/0322775 | A1 | 12/2010 | Surken |
| 2013/0302170 | A1 | 11/2013 | Booze et al. |
| 2013/0302173 | A1 | 11/2013 | Booze et al. |
| 2013/0303413 | A1 | 11/2013 | Booze et al. |
| 2016/0312791 | A1 | 10/2016 | Bellaci et al. |
| 2018/0156183 | A1 | 6/2018 | Storvold |
| 2021/0054750 | A1 | 2/2021 | Karlen et al. |
| 2021/0324747 | A1 | 10/2021 | Charlas et al. |
| 2021/0324752 | A1 | 10/2021 | Theertham et al. |

FOREIGN PATENT DOCUMENTS

| | | | |
|---|---|---|---|
| EP | 1211214 | A2 | 6/2002 |
| EP | 2743455 | A2 | 1/2018 |
| EP | 3486432 | A1 | 5/2019 |
| EP | 3600859 | A1 | 2/2020 |
| FR | 3085414 | A1 | 3/2020 |
| FR | 3096399 | B1 | 11/2020 |
| FR | 3111660 | B1 | 12/2021 |
| FR | 3121853 | A1 | 10/2022 |
| FR | 3127147 | A1 | 3/2023 |
| GB | 2089761 | A | 6/1982 |
| KR | 19990012625 | A | 2/1999 |
| WO | 2014038950 | A1 | 3/2014 |
| WO | 2015010795 | A1 | 1/2015 |
| WO | 2018172607 | A1 | 9/2018 |

CENTRIFUGAL FAN OR COMPRESSOR COMPOSITE IMPELLER WITH ABRASION RESISTANCE

FIELD OF INVENTION

The present disclosure is directed to a centrifugal fan or compressor composite impeller, and in particular, to a composite components for a centrifugal fan or compressor impeller, with the composite impeller and/or components having abrasion resistance features.

BACKGROUND

Centrifugal or radial fans or compressors are used to move and/or compress gases or vapors that move through various industrial processes which require the movement and/or compression of the gases or vapors. In some instances, the gas may contain water mists or droplets, and also may include particulates, such as liquids or solids, which result from the process. The particulates are referred to alternatively as abrasives. The main working component of a fan or compressor is the impeller, which is designed to move and compress the gas as it rotates.

As a result of the impeller rotation combined with the velocity of the gas and any abrasives entrained in the gas, the abrasives may abrade or erode the impeller material leading to reduced fan life, increased maintenance, lowered operational efficiencies or higher energy consumption, and/or possible catastrophic failure.

Existing technologies predominantly include impellers made of steel or other metals, and sometimes are made from composites such as but not limited to Carbon Fiber Reinforced Polymers/Plastics (CFRPs). Composites are made of a structural element such as but not limited to carbon fiber and a binder, such as a binding polymer that is selected for the particular application. Carbon fibers for example are strong, rigid, and lightweight. The binding polymer or binder can be a thermoset resin, such as an epoxy. The composite material is used for impellers to combat stress and to combat fatigue compared to impellers made from steel or other metals. Composite materials such as CFRP, however, have not proven to be erosion or abrasion resistant enough to hold up in applications where abrasives are present in the gas, and therefore their utilization is not practical in these applications.

Impellers made from steels or metals have limited stress and strain capabilities and are subject to fatigue and therefore are subject to failure at some point during their lifetimes once the stress or fatigue limit is reached. Impellers rotate at relatively high rotational speeds (such as in the range of 500 to 20,000 rpm), and can be operating with power loads anywhere from 50 kW to upwards of 10,000 kW. Therefore, the energy contained in one of these machines during operation can be substantial. Likewise, these machines are required to be started and stopped, and may also see regular load changes due to the demands of the process which the user is applying the machine. With each start, stop, or load change the impeller is subject to the cycle of changing loading. If the load exceeds the stress limit of the material the impeller is subject to failure. Likewise, the number and degree of load changes result in strain on the impeller material over time, and once the fatigue life limit is reached the impeller is also subject to failure.

Steels and metals are limited in their strength and corrosion resistance properties, but also limited by fatigue life for the given application. The specific steels and metals selected for an impeller are chosen by the manufacturer as the result of the most practical combination of strength, workability, corrosion resistance, and cost. The material strength must be enough to sustain the loads and stresses within the impeller itself during normal operation for some minimum expected lifetime, but also have material properties to resists the corrosive, erosive, and/or abrasive effects of the gas/vapor, any water mists or droplets which may be present, and/or any chemicals or particulates which may be present in the gas/vapor for each installation. With steels and metals available today, the strength and corrosion/erosion/abrasion resistance are limited to some significant degree such that impellers for these machines experience failure due to erosion, corrosion or fatigue life.

The loads developed by and from the impeller during the working of the machine are those such as, but not limited to, static and dynamic forces due to the impeller weight, rotational speed, thrust, power, temperature, and vibration. Impellers manufactured from steels and other metals have relatively low strength-to-weight ratio and therefore relatively high weight, mass, and inertia from impellers made of steels and metals result in significant loads to the corresponding components of the machine such as but no limited to the shaft, bearings, couplings, gear, motor or driver, support structure, and foundation. These loads result in larger, heavier, more costly components and limited lifetime and reliability and often more maintenance for these components.

The relatively high weight, mass, and inertia properties of steel and metal impellers requires significant time for the impeller to start from zero or low speed and reach its normal or full operating speed once energized, and likewise, takes significant time to decelerate and slow from normal speeds to slow speed or stop. This can often limit the user's ability to most effectively control the process which the machine is connected to, and therefore may limit their production capacity, cycle times, efficiency, and/or product quality.

SUMMARY

This present disclosure utilizes complex three-dimensional composite structures to construct the fan impeller, which improves the abrasion and erosion resistance thereof.

The present disclosure is directed generally to a centrifugal impeller that comprises a body formed of a composite material, the composite material including structural material elements such as but not limited to carbon fibers and a binder, and an anti-abrasion component forming part of the body, the anti-abrasion component including a mechanical coupler, and the anti-abrasion component being held within the body via the mechanical coupler.

In one embodiment, the body has an end, and the anti-abrasion component is located at the end.

In another embodiment, the anti-abrasion component includes a body portion and a coupling portion extending from the body portion, and the coupling portion includes the mechanical coupler.

In an alternative embodiment, the mechanical coupler includes a varying thickness of the coupling portion.

In yet alternative embodiment, the coupling portion has a first end and a second end opposite the first end, the first end is proximate the body portion, and a thickness dimension of the second end is larger than a thickness dimension of the first end.

In another embodiment, the mechanical coupler includes at least one post extending from the coupling portion.

In yet another embodiment, the mechanical coupler includes at least one hook extending from the coupling portion.

In an alternative embodiment, the coupling portion includes a first surface, a second surface opposite to the first surface, a first side, a second side opposite to the first side, and an end surface, and at least one of the first surface, the second surface, the first side, and the second side includes a textured portion.

In another embodiment, the body has a trailing edge and a leading edge, the anti-abrasion component is a first anti-abrasion component located at the trailing edge of the body, and the centrifugal impeller further comprises a second anti-abrasion component that is located at the leading edge of the body.

The present disclosure also relates to a composite impeller for a centrifugal impeller, the composite impeller including a body including an end, the body being formed of a composite material including fibers and a binder, and an anti-abrasion component being coupled to the composite material and forming part of the body, the anti-abrasion component including a mechanical coupler, the anti-abrasion component being held within the body via the mechanical coupler, and the anti-abrasion component being located at the end of the body.

In one embodiment, the anti-abrasion component includes a body portion and a coupling portion extending from the body portion, and the coupling portion includes the mechanical coupler.

In another embodiment, the mechanical coupler includes a varying thickness of the coupling portion.

In yet another embodiment, the coupling portion has a first end and a second end opposite the first end, the first end is proximate the body portion, and a thickness dimension of the second end is larger than a thickness dimension of the first end.

In an alternative embodiment, the mechanical coupler includes at least one post extending from the coupling portion.

In another embodiment, the mechanical coupler includes at least one hook extending from the coupling portion.

In one embodiment, the coupling portion includes a first surface, a second surface opposite to the first surface, a first side, a second side opposite to the first side, and an end surface, and at least one of the first surface, the second surface, the first side, and the second side includes a textured portion.

The present invention also relates to a method of manufacturing a composite impeller, the method comprising the steps of placing fibers in one of a form, mold or layup, positioning an anti-abrasion component in the mold with the fibers, engaging at least one of the fibers with the anti-abrasion component, inserting a binder in the form, mold or layup, and curing the binder to form the composite impeller.

In one embodiment, the anti-abrasion component includes a mechanical coupler, and the step of engaging the at least one of the fibers includes engaging the at least one of the fibers with the mechanical coupler.

In another embodiment, the mechanical coupler includes one of a post or a hook extending from the anti-abrasion component, and the step of engaging at least one of the fibers includes positioning the at least one of the fiber around the one of a post or a hook.

In yet another embodiment, the curing the binder results in at least one of the fibers or the binder wrapping around the anti-abrasion component in the composite impeller.

BRIEF DESCRIPTION OF THE DRAWINGS

To complete the description and in order to provide for a better understanding of the techniques presented in this application, a set of drawings is provided. The drawings form an integral part of the description and illustrate an embodiment of the present application, which should not be interpreted as restricting the scope of the present application, but just as an example of how the techniques presented herein can be carried out. The drawings comprise the following figures.

Like reference numerals have been used to identify like elements throughout this disclosure.

DETAILED DESCRIPTION

Figure 1:
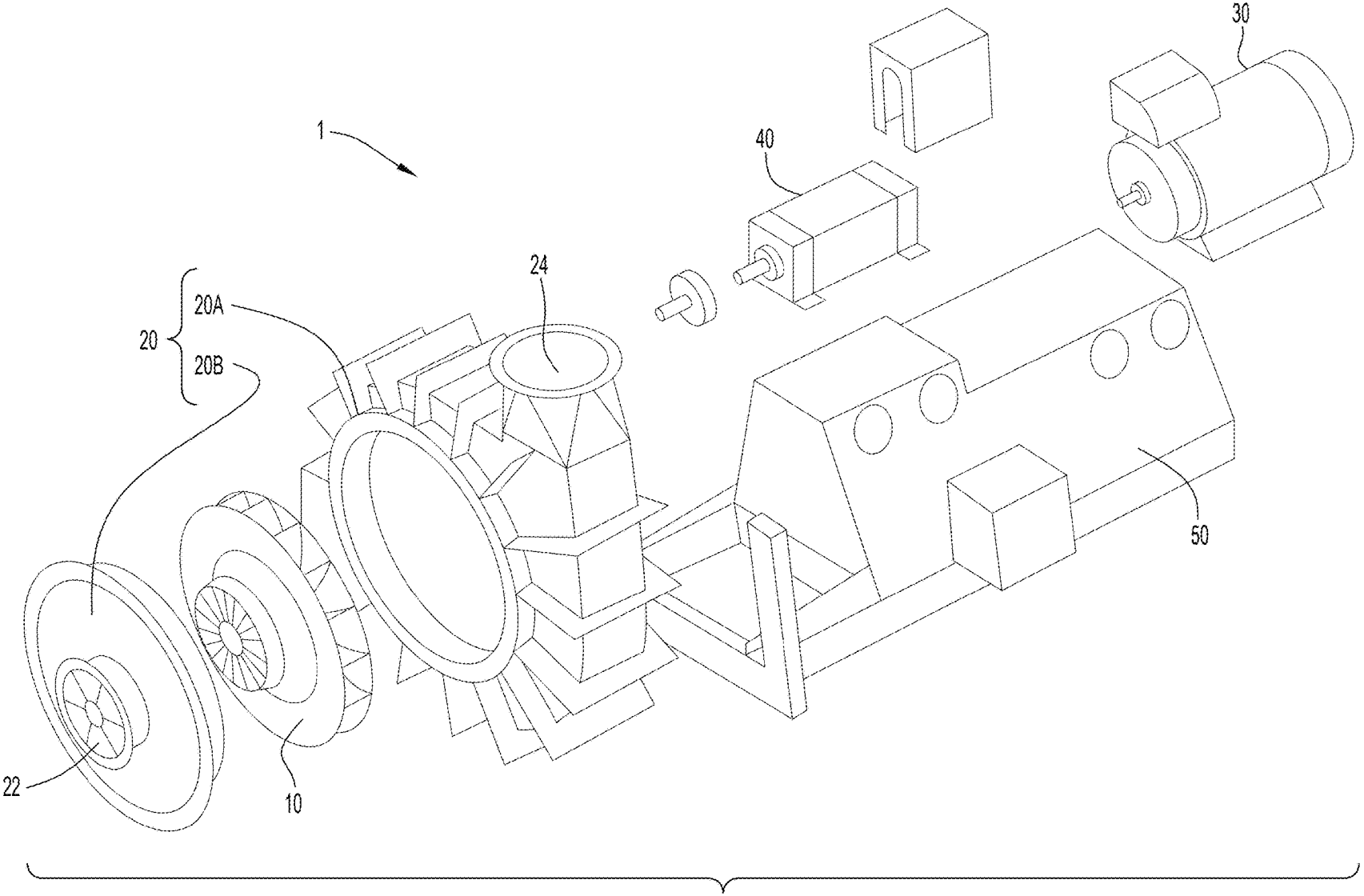
FIG. 1 is an exploded view of a centrifugal fan including an impeller formed in accordance with an exemplary embodiment of the present application.

The following description is not to be taken in a limiting sense, but is given solely for the purpose of describing the broad principles of the invention. Embodiments of the present application are described by way of example, with reference to the above-mentioned drawings showing elements and results according to the techniques presented herein.

The solution is a fan impeller made of complex three-dimensional composite structures which results in the combination of mechanical properties and abrasion and erosion resistance, which allows for improved utility, functionality, reliability, cost, and safety for the user. The specific composite structures vary based on fan size and design as well as the gas and application requirements relative to, such as but not limited to, temperature, corrosivity, and abrasiveness, and may include, but are not limited to, combinations of composite structural elements such as but not limited to carbon fibers, resins, 3D printed reinforcement structures, cast reinforcement structures, and/or fabricated reinforcement structures.

Impellers made from three-dimensional composite structures provide the abrasion and erosion resistance required, but also have lower weight, mass, and inertia resulting in lower costs and enhanced lifetime, reliability, and utility for the user. The lighter and lower inertia impellers enable the following benefits:

Greater number of operational cycles (i.e. starts/stops, speed/load changes, etc.) as the structure sustains higher limits than impellers made from other materials while providing the level of erosion and abrasion resistance. This increases the reliability, lifetime, and utility for the user.

Increased safety and reliability with lower maintenance time and cost leading to increased user operational time. The complex composite structure has higher fatigue limits and different failure modes compared to other materials combined with lower mass, therefore the risk of an impeller failure is reduced, thus reducing the frequency and extent of preventative maintenance for the user. Likewise and in the event of a failure the lower mass decreases the risk of catastrophic repercussions to persons, machinery, and facilities.

The composite structure materials can offer a broader range of corrosion resistant properties than steels and metals, therefore improving lifetime and reliability and lowering maintenance time and cost.

Fans with a complex composite structure impeller which is lighter results in significantly lower loads to the corresponding components of the machine such as, but no limited to, the shaft, bearings, couplings, gear, motor or driver, support structure, and foundation. The resulting improved component designs increase overall lifetime and reliability while lowering maintenance time and costs for the components.

The relatively low weight, mass, and inertia properties and corresponding component designs result in significantly lower acceleration and deceleration times for the machine start/stop and load changes, thus enhancing the user's ability to most effectively control the process which the machine is connected to, and potentially increasing their production capacity, cycle times, efficiency, and/or product quality.

In one aspect of the present disclosure, metallic erosion resistant elements are added at both the leading edges and trailing edges of the blades which incorporate small portions of the "sides" of the blades. In this aspect, no bonding (such as by using an adhesive) is needed or used.

Referring to FIG. 1, an exemplary embodiment of a centrifugal fan system 1 is illustrated. The fan system 1 includes an impeller 10 housed in a casing 20. The impeller 10 is coupled to a motor 30 via a bearing unit 40. A support structure 50 supports the impeller 10, the casing 20, the motor 30, and the bearing unit 40. The casing 20 includes a base portion 20A and a cap portion 20B. The cap portion 20B defines an inlet 22 to the impeller 10 and the base portion 20A defines a volute for receiving the impeller 10 and an outlet 24. The motor 30 and the bearing unit 40 are configured to rotate the impeller 10 to induce a flow of air or other gas composition from the inlet 22 through the impeller 10 and casing 20 to the outlet 24. The motor 30 may have a variable frequency drive that adjusts the rotational speed of the impeller based on a control signal or the motor may have a fixed speed. The bearing unit 40 supports the impeller and the shaft in axial and radial direction.

Figure 2A:
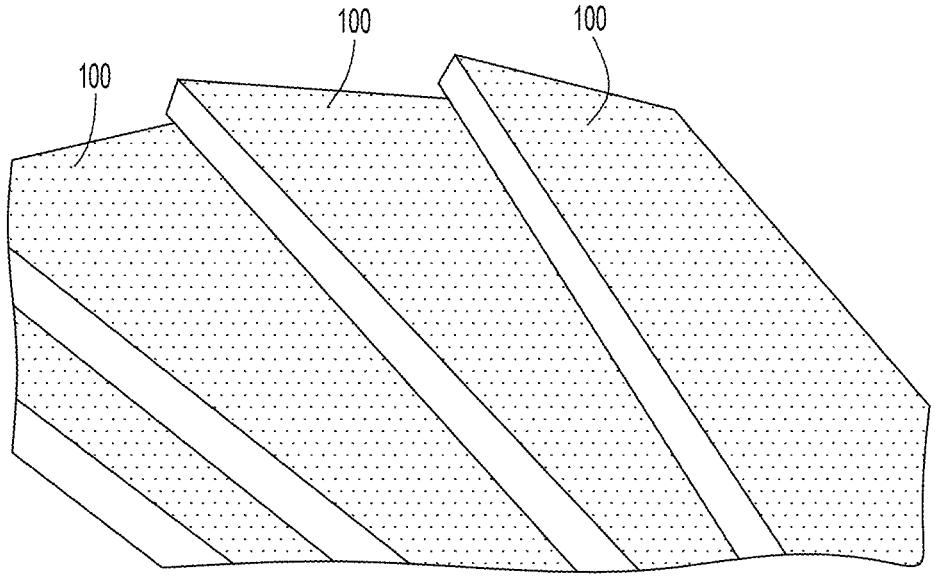
FIG. 2A is a perspective view of an example embodiment of composite blades for an impeller according to an aspect of the present application.
Figure 2B:
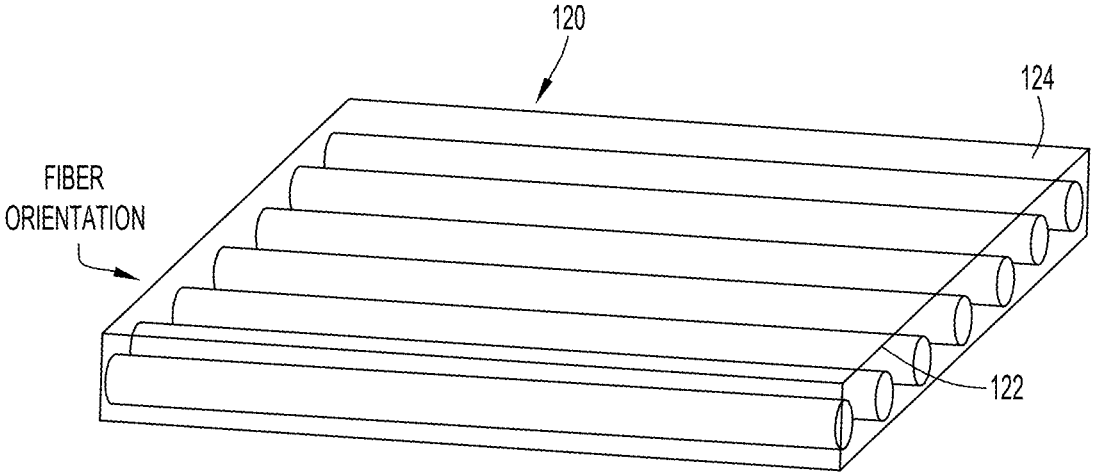
FIG. 2B is a perspective schematic view of carbon fibers in a binder for a composite blade.
Figure 2C:
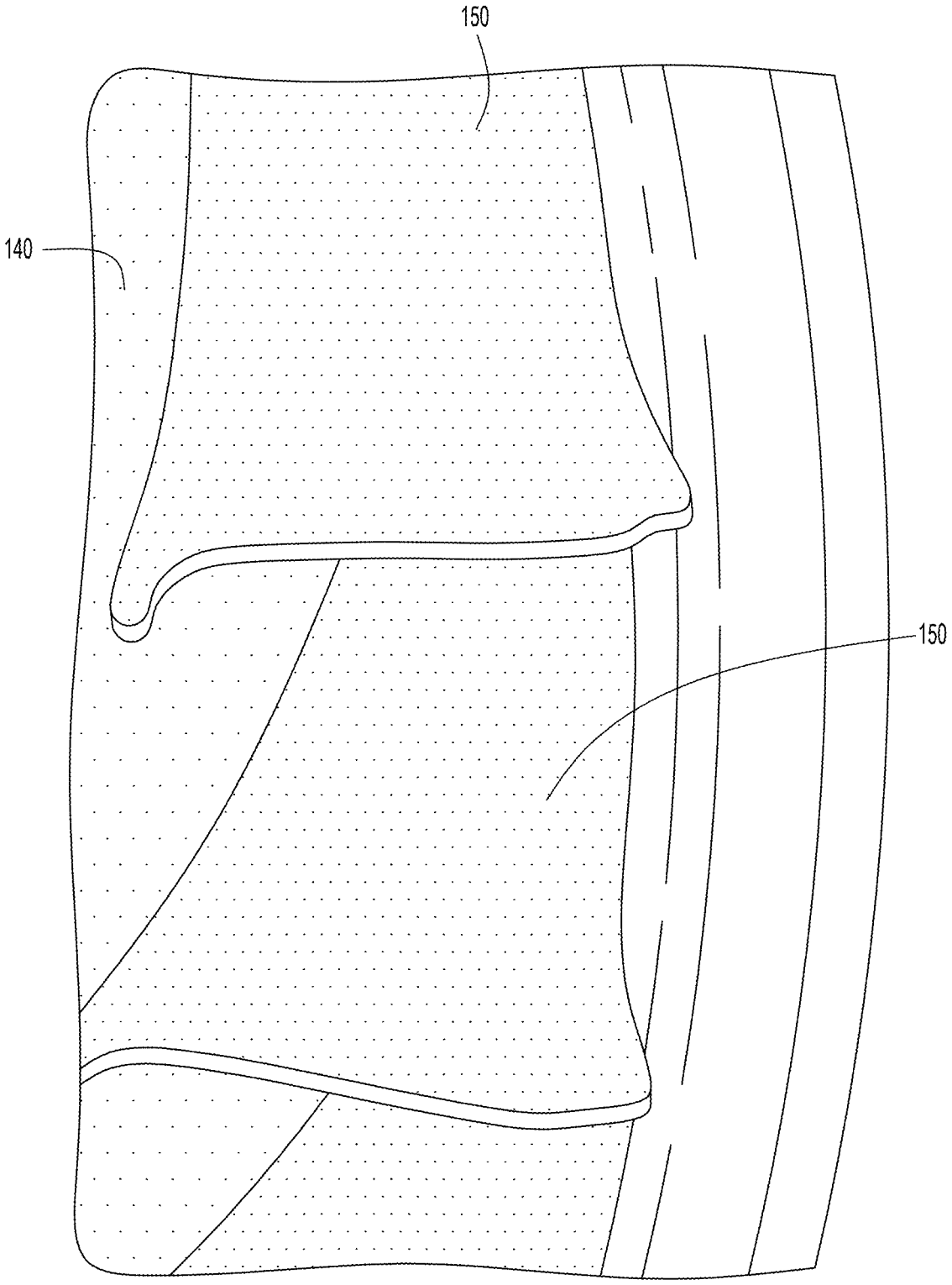
FIG. 2C is a perspective view of a portion of an impeller with composite blades.

Turning to FIGS. 2A-2C, different views of exemplary embodiments of composite blades and an impeller are illustrated. In FIG. 2A, several composite blades 100 are illustrated, each of which includes carbon fibers in a cured binder, such as a resin. In FIG. 2B, a schematic view of an example embodiment of a composite blade 120 that has several carbon fibers 122 located in a cured binder 124. A portion of a composite impeller is illustrated in FIG. 2C. In this view, part of the composite impeller 140 and several composite blades 150 are shown.

For an impeller 140 formed from a composite material, each blade 150 may be formed from prepreg composite fabrics, glass fibers, carbon fibers, resin, or any other suitable materials. In some implementations, because the blades define the back plate and the cover plate of the impeller, those parts are also formed from the same composite material as the blades. Additionally, a hub may also be formed from metal or a composite material (e.g., carbon fiber, glass fiber, and/or resin). The composite material allows the impeller and blades to be easily formed into any desired shape, and also provides comparable strength to steel, but with much less weight.

Figure 3:
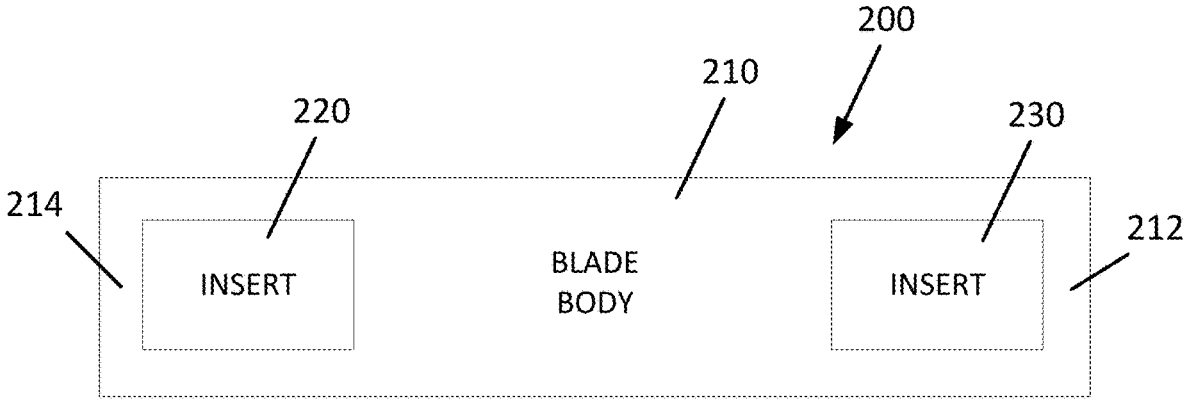
FIG. 3 is a schematic diagram of an embodiment of a composite blade according to an aspect of the present application.

Turning to FIG. 3, a schematic diagram of an embodiment of a composite blade according to an aspect of the present application is illustrated. In this embodiment, the composite blade 200 includes a blade body 210, which includes carbon fibers and a binder, such as an epoxy or resin. The composite blade 200 and the blade body 210 can be any desired shape and length, and the schematic diagram showing the blade 200 and body 210 is illustrative only, and is not intended to convey any particular configuration.

The structural fibers are oriented in different directions, and in some implementations, can be woven with each other. A woven pattern of the fibers can be in the X and Y directions. In one embodiment, several layers of fibers are provided in a fiber mesh arrangement. Layers of fibers in between other layers of carbon fibers are bonded internally to each other.

The blade body 210 has opposite ends or edges 212 and 214. In one implementation, end or edge 212 can be a trailing edge of the composite blade 200. Similarly, end or edge 214 that is located opposite to end or edge 212 can be a leading edge of the composite blade 200.

In this embodiment, the composite blade 200 includes at least one insert that is intended to provide anti-abrasion characteristics to the blade 200. In FIG. 3, the blade 200 is shown with two inserts. However, in different embodiments, the blade 200 may only have a single insert. An insert can be referred to alternatively as an inlay, and the insert or inlay can also be referred to as an anti-abrasion component. The inlay or the anti-abrasion component is a metallic element, which can be titanium or other metal, depending on the needs of the use. In different embodiments, the anti-abrasion component can be placed in a variety of locations, including any of a blade leading edge, a blade trailing edge, a blade working pressure face, a backplate, and a hub conc.

The composite blade 200 has two inserts 220 and 230 located at opposite ends of the blade body 210. Insert 220 is positioned proximate to end or edge 214, and insert 230 is positioned proximate to end or edge 212. Each of the inserts 220 and 230 is located within the blade body 210.

Figure 4:
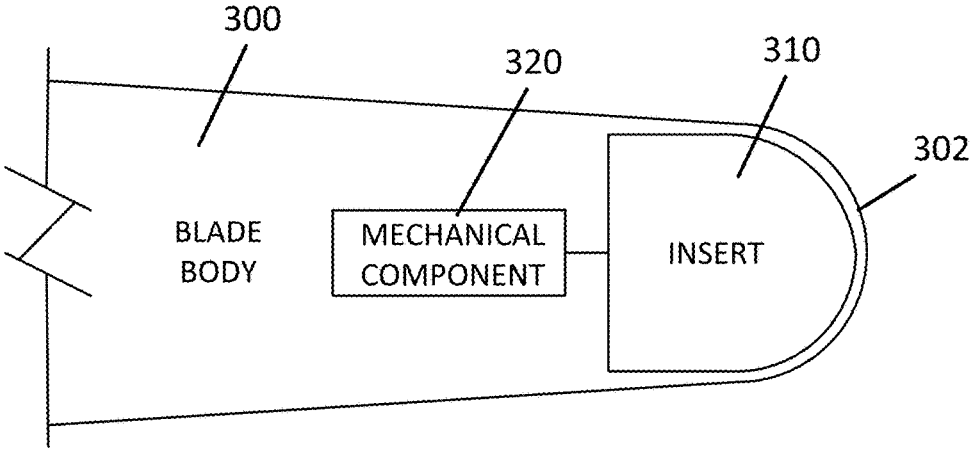
FIG. 4 is a schematic diagram of a portion of another embodiment of a composite blade according to an aspect of the present application.

Turning to FIG. 4, a schematic diagram of a portion of another embodiment of a composite blade is illustrated. One end or edge 302 of the blade body 300 of another composite blade is shown. The blade body 300 has an insert 310 located proximate to edge 302. The insert 310 is an anti-abrasion component that improves the longevity of the blade body 300. The insert 310 is retained in the composite structure (the composite blade) by positive contact mechanical elements or components. The insert 310 has a mechanical coupler or mechanical component 320 that is used to help retain the insert 310 in the blade body 300. In various embodiments, the mechanical component 320 can be one or more of a post, a pin, a hook, a protrusion, a channel, a textured surface, other hardware, or an increased thickness or tapering of a surface. The mechanical components or elements can be formed using any combination of techniques, including being machined, formed, embedded, and/or fastened. Each mechanical component functions as an "anchor" for the insert within the composite structure.

Figure 5:
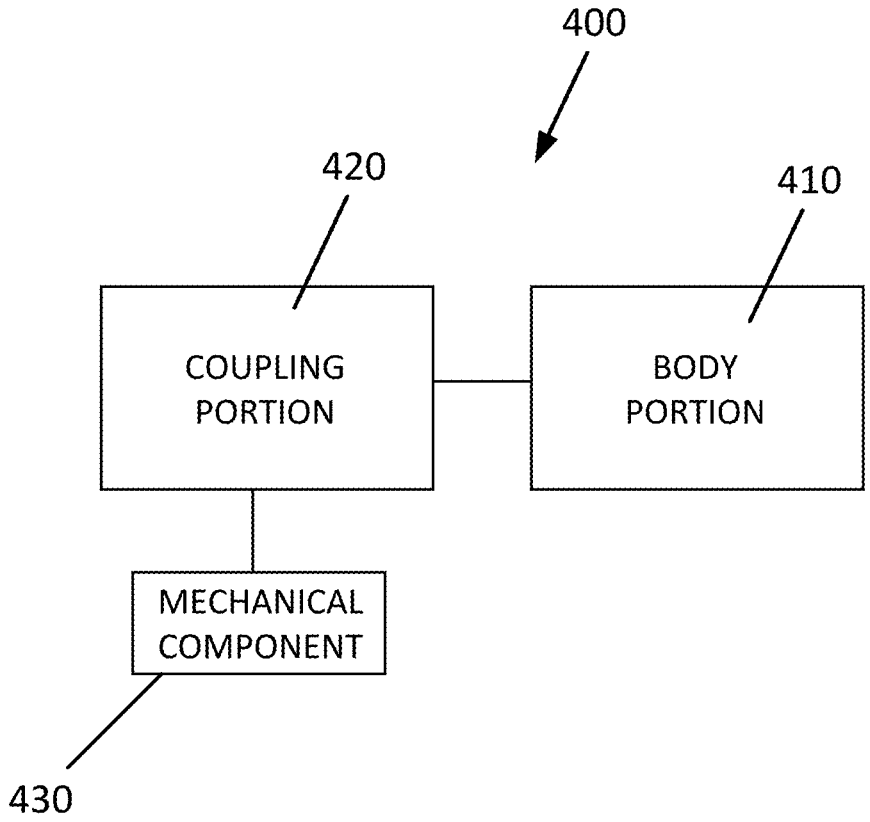
FIG. 5 is a schematic diagram of an embodiment of an anti-abrasion component according to an aspect of the present application.

Referring to FIG. 5, a schematic diagram of an embodiment of an anti-abrasion component is illustrated. The anti-abrasion component 400 includes a body portion 410 and a coupling portion 420 connected to the body portion 410. The coupling portion 420 has a mechanical component 430 that is connected thereto. The mechanical component 430 can be integrally formed with the coupling portion 420. Alternatively, the mechanical component 430 can be formed separately from the coupling portion 420 and subsequently connected to the coupling portion 420. The mechanical component 430 can be placed at different locations on the coupling portion 420. Also, in different embodiments, the mechanical component 430 may include several different features or structures connected to the coupling portion 420.

Figure 6A:
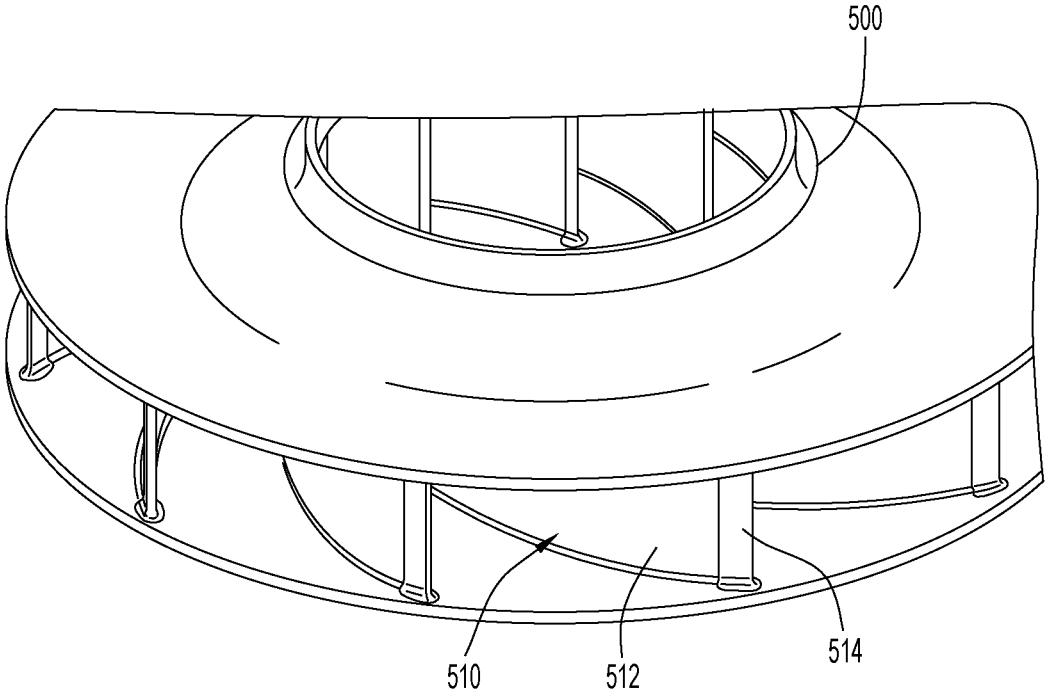
FIGS. 6A and 6B are exploded perspective views showing an embodiment of an impeller with a spaced apart anti-abrasion component according to an aspect of the present application.
Figure 6B:
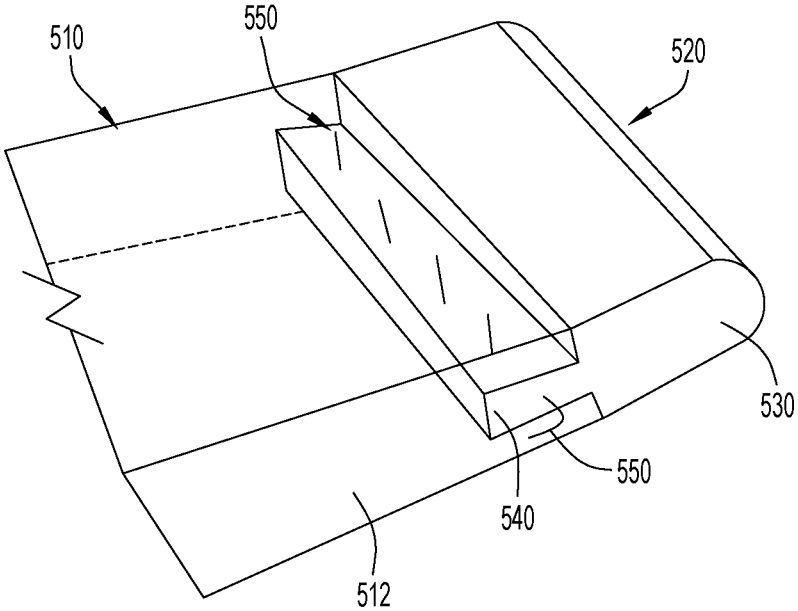

An embodiment of an impeller is illustrated in FIGS. 6A and 6B. The impeller 500 has multiple blades 510, each of which has a body 512 with opposite ends or edges 514 (only one of which is shown). In FIG. 6A, an exemplary embodiment of an anti-abrasion component 520 that forms part of the blade 510 is shown. The anti-abrasion component 520 includes a body portion 530 and a coupling portion 540. In this embodiment, the coupling portion 540 has a mechanical component 550 that is used to retain the anti-abrasion component 520. The mechanical component 550 is a series of projections that can be engaged by carbon fibers in the blade body 512. The mechanical component 550 functions as an anchor to keep the anti-abrasion component 520 in the blade body 512.

Figure 7:
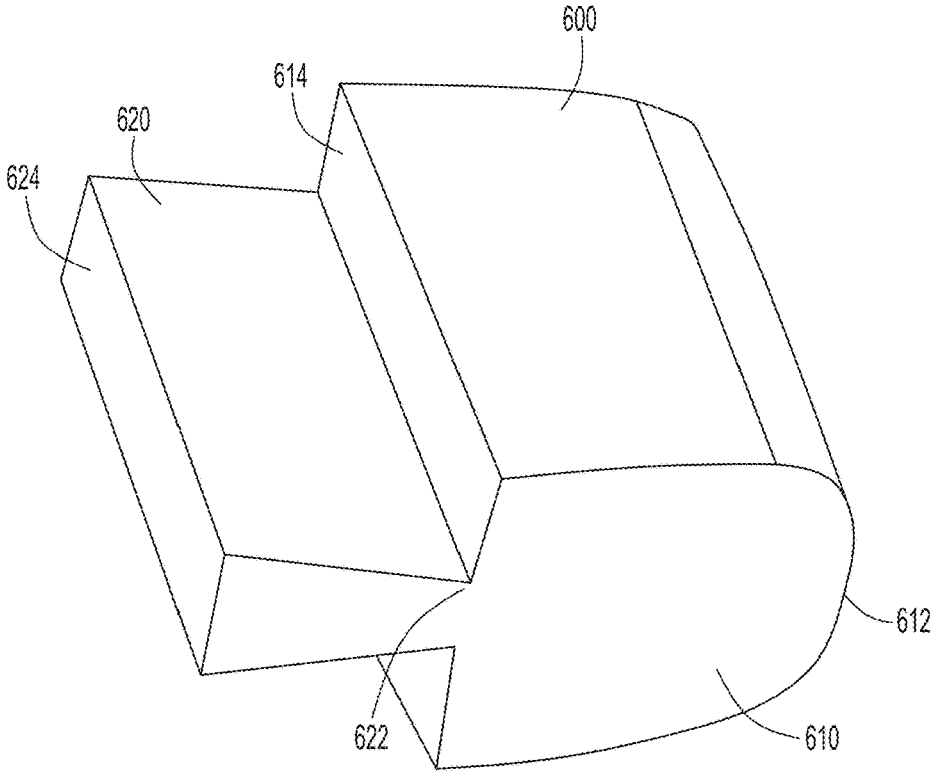
FIG. 7 is a perspective view of an embodiment of an anti-abrasion component according to an aspect of the present application.
Figure 8:
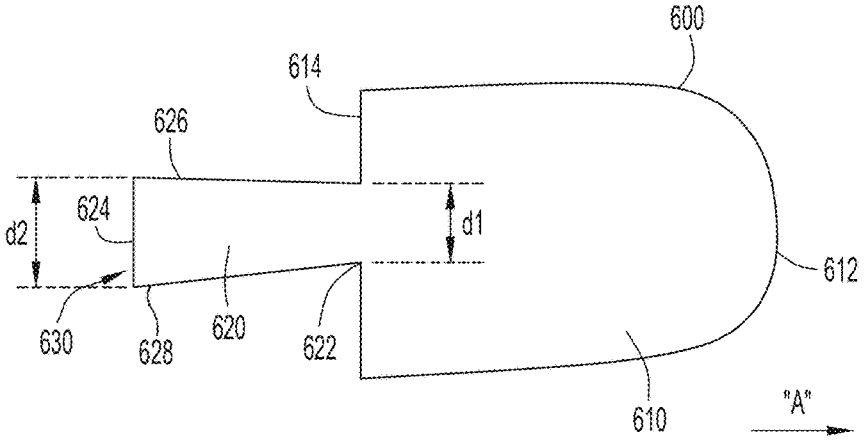
FIG. 8 is a side view of the anti-abrasion component illustrated in FIG. 7.
Figure 9:
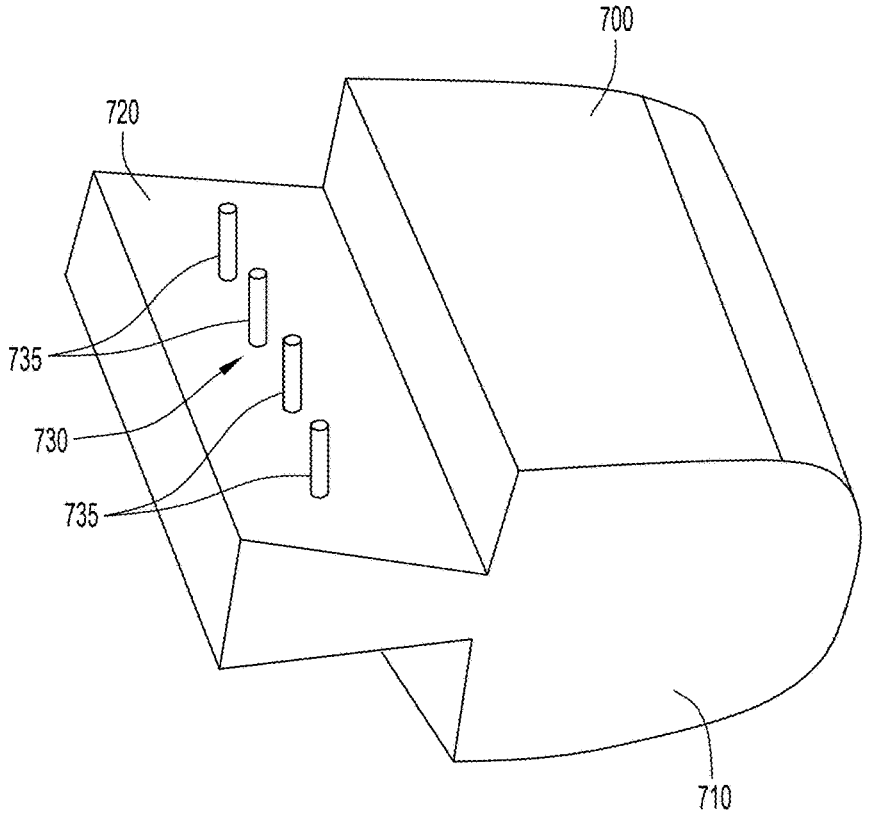
FIG. 9 is a perspective view of another embodiment of an anti-abrasion component according to an aspect of the present application.

Turning to FIGS. 7 and 8, another embodiment of an anti-abrasion component is illustrated. In this embodiment, the anti-abrasion component 600 includes a body portion 610 and a coupling portion 620 extending from the body portion 610. The body portion 610 has a first end 612 and a second end 614 that is opposite to the first end 612. The first end 612 is the end of the anti-abrasion component 600 that is proximate to the end or edge of the blade in which the anti-abrasion component 600 is located. The second end 614 is located inwardly of the blade body. In one embodiment, the anti-abrasion component 600 can have one or more surfaces that are tapered.

The coupling portion 620 has a first end 622 that is located proximate to the body portion 610 and a second end 624 that is opposite to the first end 622. The coupling portion 620 also has a first surface 626 and a second surface 628 that is opposite to the first surface 626. The coupling portion 620 has a mechanical component 630 that is used to retain the anti-abrasion component 600 in the blade body. In this embodiment, the mechanical component 630 is the varying thickness of the coupling portion 620. As shown in FIG. 8, the coupling portion 620 at end 622 has a thickness dimension of d1 and the coupling portion 620 at end 624 has a thickness dimension of d2. In this embodiment, the thickness dimension d2 is greater than the thickness dimension d1. The increased thickness dimension d2 in the cured composite blade body functions as an anchor in the cured composite blade and resists movement of the anti-abrasion component 600 in the direction of arrow "A" when the impeller rotates.

Turning to FIGS. 9 through 13, another embodiment of an anti-abrasion component is illustrated. Initially referring to FIG. 9, the anti-abrasion component 700 includes a body portion 710 and a coupling portion 720 extending from the body portion 710. The coupling portion 720 has a mechanical component 730 that assists with retaining the anti-abrasion component 700 in the composite blade body. The mechanical component 730 includes several spaced-apart posts 735 extending from a surface of the coupling portion 720. When the binder of the blade body is cured, the carbon fibers in the blade body and the cured binder engage the anti-abrasion component 700, and in particular, the posts 735 as well.

Figure 10:
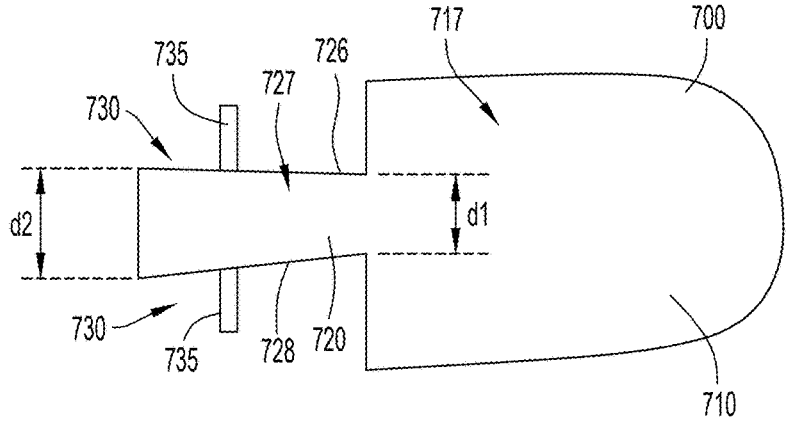
FIG. 10 is a side view of the anti-abrasion component illustrated in FIG. 9.

In FIG. 10, the body portion 710 of the anti-abrasion component 700 includes a first side 717. Similarly, the coupling portion 720 includes its own first side 727. In this embodiment, first side 717 and first side 727 are continuous with each other and are in a continuous plane. The coupling portion 720 is tapered from dimension d2 to dimension d1. The coupling portion also has opposite surfaces 726 and 728. In this embodiment, the coupling portion 720 includes two different mechanical components 730. One mechanical component 730 is the tapered configuration of the coupling portion 720. Another mechanical component 730 is the different sets of projections or posts 735 that extend from both of the surfaces 726 and 728. One set of posts 735 extends outwardly from surface 726. In addition, another set of posts 735 extends outwardly from surface 728 in a direction opposite to the posts 735 extending from surface 726. In an alternative embodiment, the coupling portion 720 includes posts 735 extending from one of the surfaces 726 and 728, and the other of the surfaces 726 and 728 does not have any posts 735.

Figure 11:
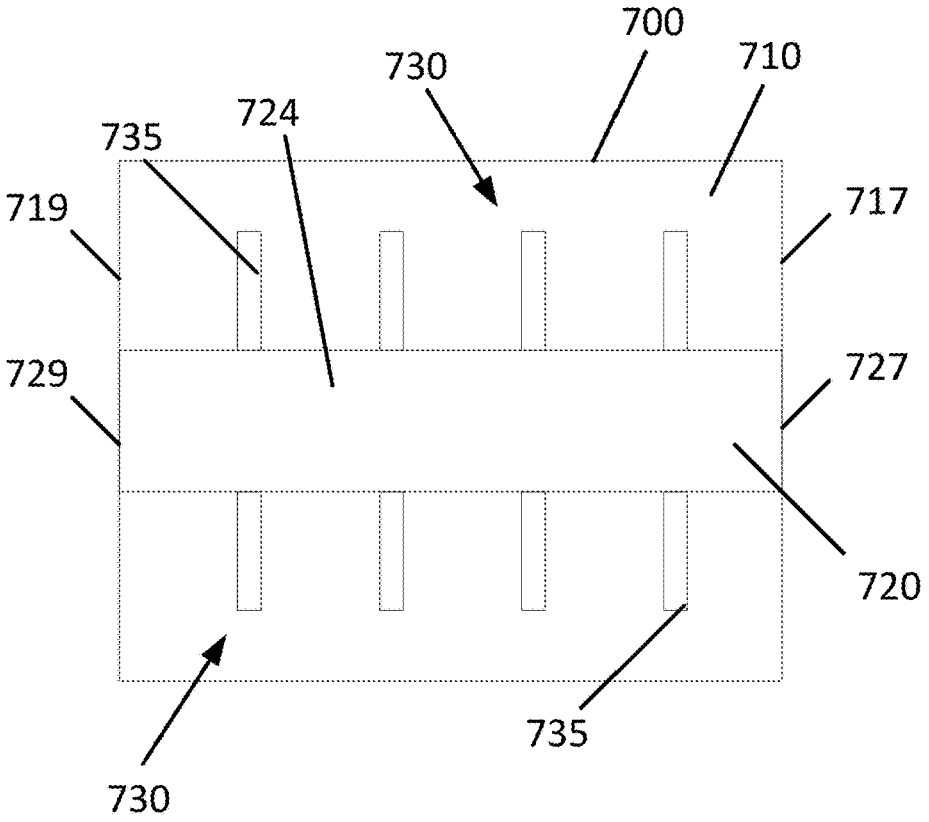
FIG. 11 is an end view of the anti-abrasion component illustrated in FIG. 9.
Figure 12:
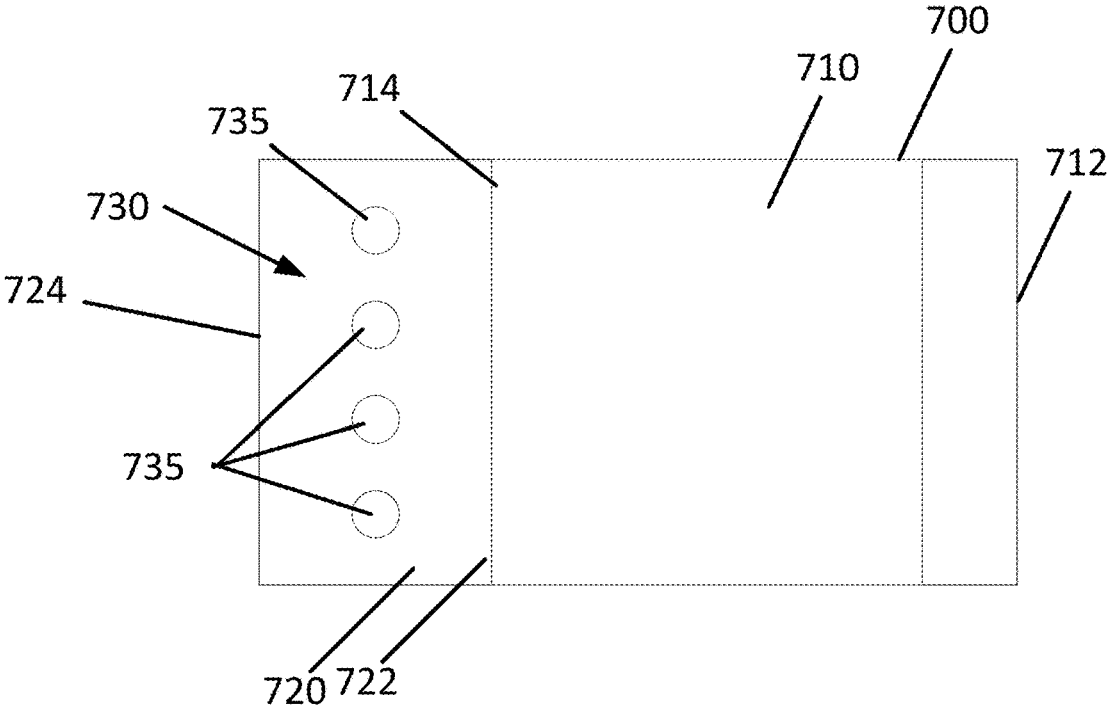
FIG. 12 is a top view of the anti-abrasion component illustrated in FIG. 9.

Turning to FIGS. 11 and 12, an end view and a top view, respectively, of the anti-abrasion component 700 are illustrated. The body portion 710 of the anti-abrasion component 700 includes a first end 712 and second end 714 opposite the first end 712. In addition, the body portion 710 has opposite sides 717 and 719. The coupling portion 720 includes opposite ends 722 and 724 and opposite sides 727 and 729. As shown in FIG. 11, sides 717 and 727 are coplanar and sides 719 and 729 are coplanar. As a result, body portion 710 and coupling portion 720 have the same width dimension.

Figure 13:
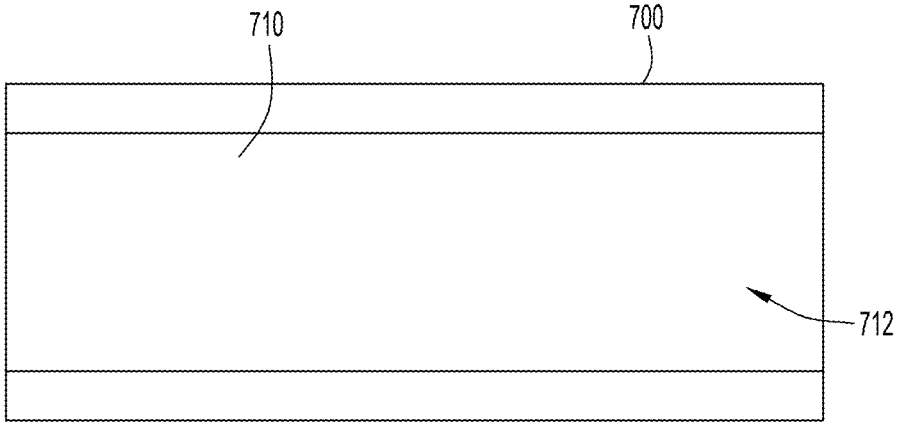
FIG. 13 is another end view of the anti-abrasion component illustrated in FIG. 9.
Figure 14:
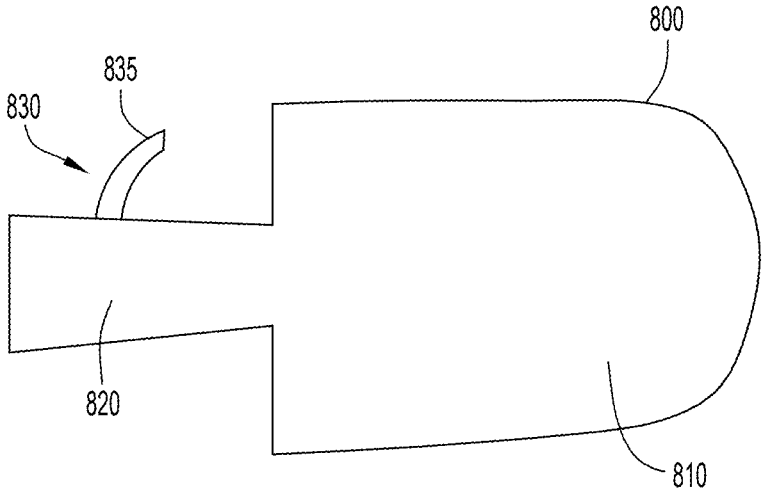
FIG. 14 is a side view of another embodiment of an anti-abrasion component according to an aspect of the present application.

The various posts 735 forming the mechanical components 730 are also illustrated. Referring to FIG. 13, an end view of the anti-abrasion component 700 that shows the end 712 of the body portion 710 is illustrated.

Various alternative embodiments of anti-abrasion components are also contemplated by this disclosure. Such alternative embodiments are illustrated in FIGS. 14-18. Initially referring to FIG. 14, an anti-abrasion component 800 has a body portion 810 and a coupling portion 820 extending therefrom. The coupling portion 820 includes a mechanical component 830 which, in this implementation, includes several hooks 835 that are not linear. In different embodiments, the locations, lengths, and shape of the hooks 835 can vary. Also, in an alternative embodiment, the hooks 835 can be provided on opposing surfaces of the coupling portion 820.

Figure 15:
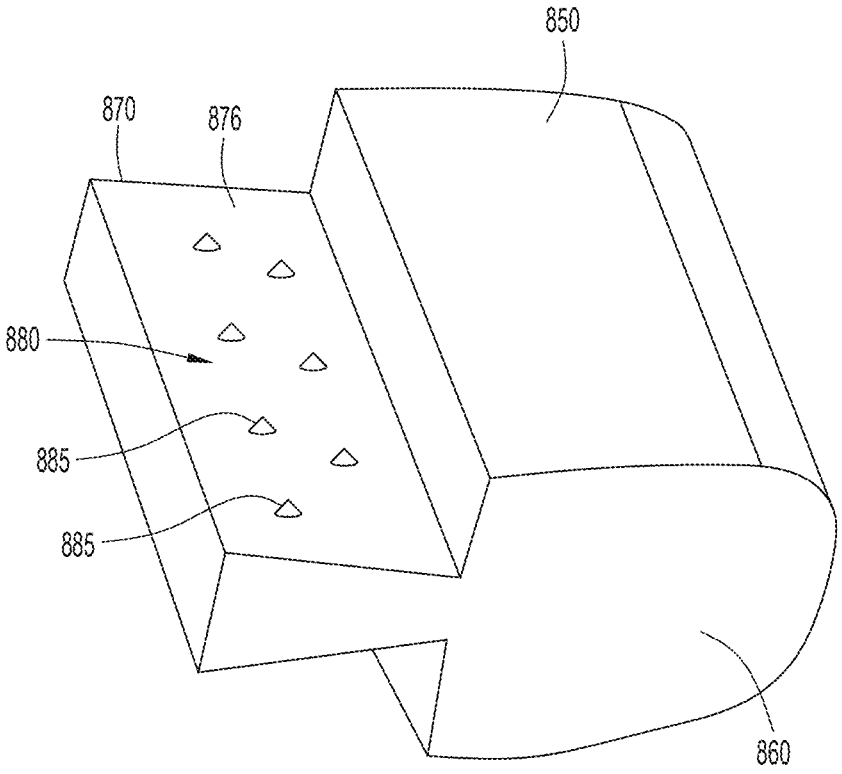
FIG. 15 is a perspective view of another embodiment of an anti-abrasion component according to an aspect of the present application.

Turning to FIG. 15, the anti-abrasion component 850 has a body portion 860 and a coupling portion 870 extending therefrom. The coupling portion 870 has a surface 876 that has a mechanical component 880 formed thereon. In this implementation, the mechanical component 880 includes several projections 885 that collectively form roughened or textured portions on surface 876. The textured surface assists with maintaining the anti-abrasion component 850 in the blade body.

Figure 16:
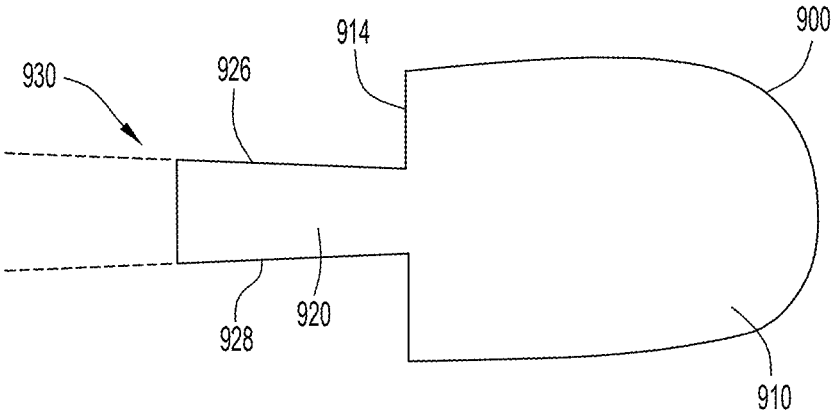
FIG. 16 is a perspective view of another embodiment of an anti-abrasion component according to an aspect of the present application.

In FIG. 16, the anti-abrasion component 900 has a body portion 910 and a coupling portion 920 extending therefrom. The coupling portion 920 has one surface 926 that is tapered and that is not perpendicular to surface 914 of body portion 910. The coupling portion 920 has another surface 928 that is opposite to surface 926 and that extend perpendicularly to surface 914 of body portion 910. The tapered surface 926 and the corresponding increase in thickness of coupling portion 920 form the mechanical component 930 of component 900.

Figure 17:
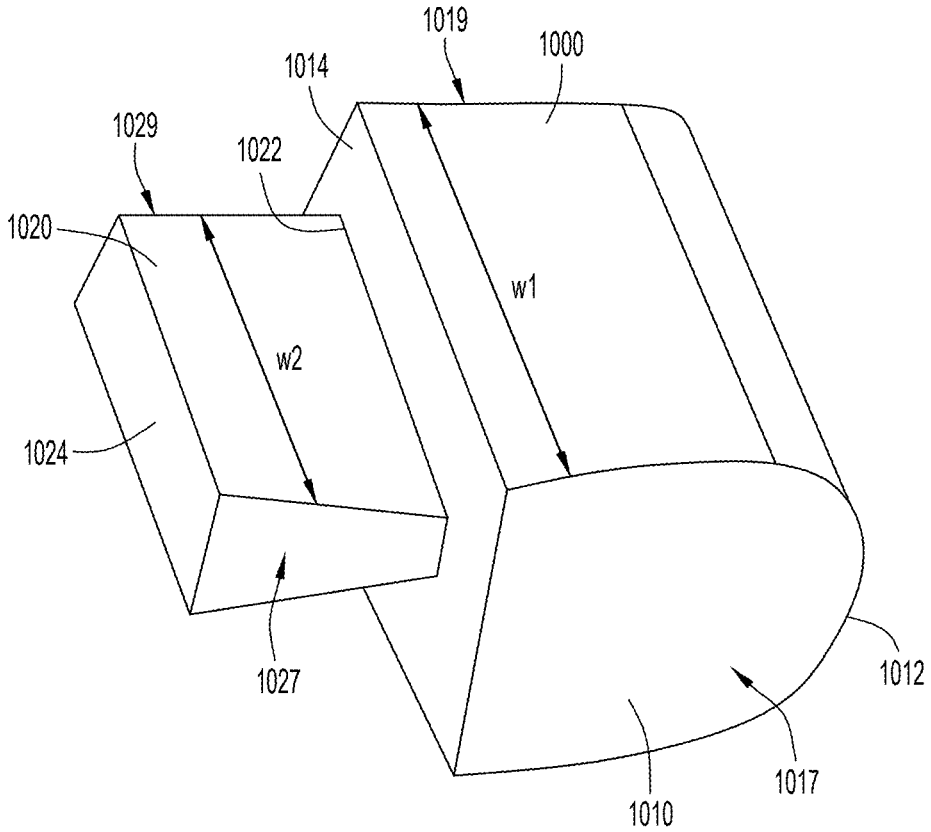
FIG. 17 is a side view of another embodiment of an anti-abrasion component according to an aspect of the present application.

Referring to FIG. 17, another embodiment of an anti-abrasion component is illustrated. Anti-abrasion component 1000 includes a body portion 1010 and a coupling portion 1020 extending from the body portion 1010. The body portion 1010 has a first end 1012 and a second end 1014 that is opposite to the first end 1012. The first end 1012 is the end of the anti-abrasion component 1000 that is proximate to the end or edge of the blade in which the anti-abrasion component 1000 is located. The body portion 1010 also has opposite sides 1017 and 1019 that define a width dimension "w1" therebetween.

The coupling portion 1020 has a first end 1022 that is located proximate to the body portion 1010 and a second end 1024 that is opposite to the first end 1022. The coupling portion 1020 also has opposite sides 1027 and 1029 that define a width dimension "w2" therebetween. In this implementation, width dimension "w2" is less than width dimension "w1". As a result, sides 1017 and 1027 are not coplanar, and sides 1019 and 1029 are not coplanar.

Figure 18:
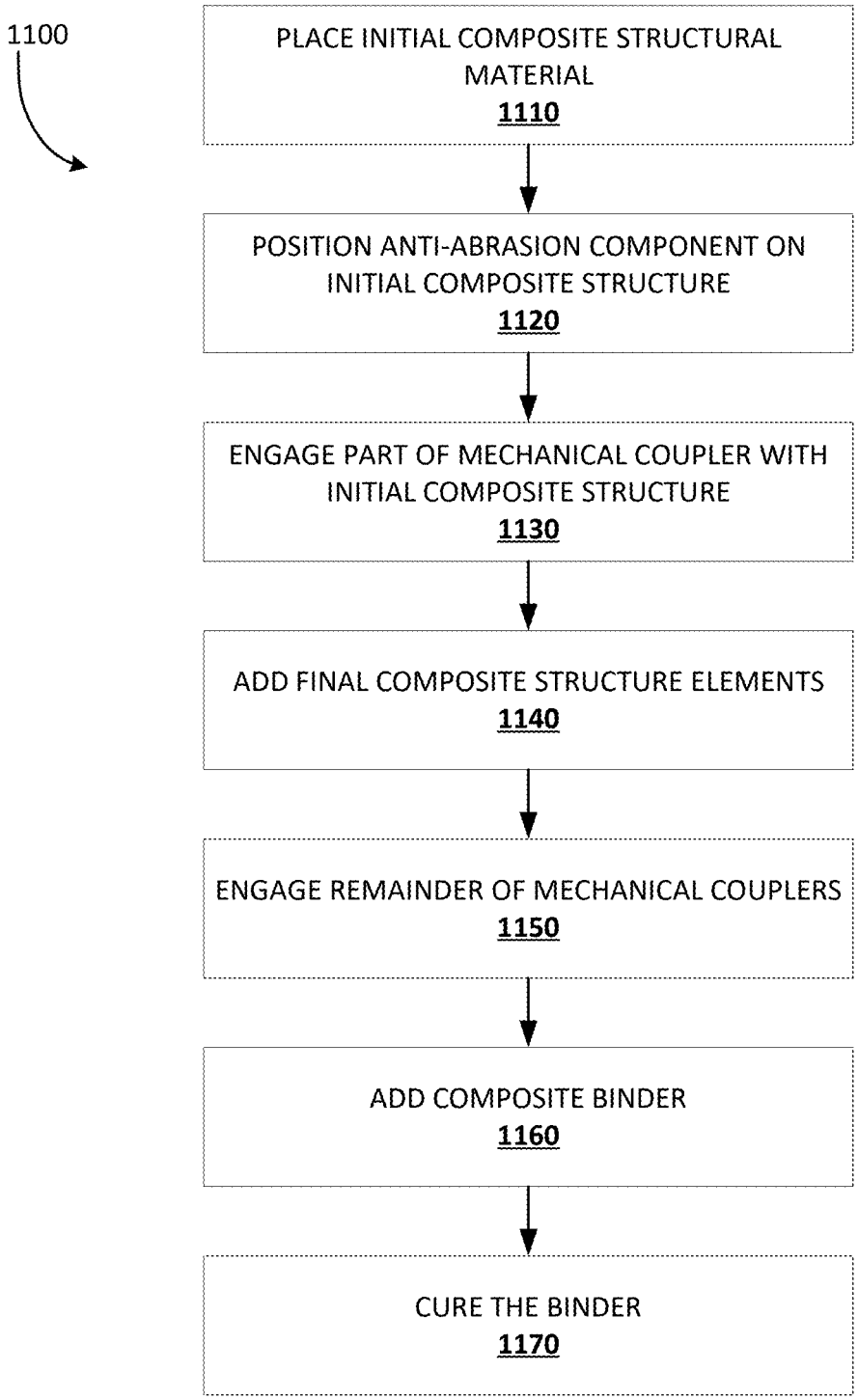
FIG. 18 is a flowchart illustrating an exemplary method according to an aspect of the present application.

Turning to FIG. 18, a flowchart showing an exemplary method of manufacturing a composite impeller according to an aspect of the present application is illustrated. The method 1100 includes several steps that are described in detail below. In different embodiments, the steps of the method of manufacturing can vary.

In step 1110, the initial composite structural material, such as structural fibers, is placed into a form, a mold, or a layup. The structural fibers are stacked and rotated in the form, mold, or manual layup to build a geometric arrangement of the fibers.

In step 1120, an anti-abrasion component is placed or positioned in the initial structural fibers. The anti-abrasion component is located so that it is next to an end of the composite impeller component, such as a blade. As the anti-abrasion component or insert is put in the form, mold, or layup, the fibers are moved. The insert can be put through the carbon fibers. Alternatively or in addition, the fibers may go over the insert.

In some implementations, two anti-abrasion components are included in the composite component. In that method, the anti-abrasion components are positioned in step 1120 to be at opposite ends of the to-be-formed composite component (i.e. blade).

In step 1130, at least one of the fibers in the form, mold, or layup is engaged with the anti-abrasion component. This engagement can occur in several different ways. One way involves at least one of the fibers being wrapped around the body portion of the anti-abrasion component. Another way involves at least one of the fibers being wrapped around the coupling portion of the anti-abrasion component. An alternative way involves at least one of the fibers being wrapped around a mechanical component or mechanical coupler of the coupling portion. For example, the at least one of the fibers can be wrapped around a post, a hook, or other projection on the coupling portion.

In step 1140, additional composite structure elements are added into the form, mold, or layup.

In step 1150, the composite structure elements are manipulated to engage the remainder of the mechanical couplers.

In step 1160, a binder is added into the form, mold, or layup. The binder can be an epoxy or similar material that has a standard strength or an enhanced strength, depending on the desired properties of the composite structure.

In step 1170, the binder is cured, which results in the composite structure being formed with fibers and the one or more anti-abrasion components being located in the cured binder.

Each example embodiment disclosed herein has been included to present one or more different features. However, all disclosed example embodiments are designed to work together as part of a single larger system or method. This disclosure explicitly envisions compound embodiments that combine multiple previously-discussed features in different example embodiments into a single system or method.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Reference may be made to the spatial relationships between various components and to the spatial orientation of various aspects of components as depicted in the attached drawings. However, as will be recognized by those skilled in the art after a complete reading of the present disclosure, the devices, components, members, apparatuses, etc. described herein may be positioned in any desired orientation. Thus, the use of terms such as "above," "below," "upper," "lower," "top," "bottom," or other similar terms to describe a spatial relationship between various components or to describe the spatial orientation of aspects of such components, should be understood to describe a relative relationship between the components or a spatial orientation of aspects of such components, respectively, as the components described herein may be oriented in any desired direction. When used to describe a range of dimensions and/or other characteristics (e.g., time, pressure, temperature, distance, etc.) of an element, operations, conditions, etc., the phrase "between X and Y" represents a range that includes X and Y.

For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment.

Further, the present disclosure may repeat reference numerals and/or letters in the various examples. This repetition is for the purpose of simplicity and clarity and does not in itself dictate a relationship between the various embodiments and/or configurations discussed.

Similarly, when used herein, the term "comprises" and its derivations (such as "comprising," etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially".

As used herein, unless expressly stated to the contrary, use of the phrase "at least one of," "one or more of," "and/or," variations thereof, or the like are open-ended expressions that are both conjunctive and disjunctive in operation for any and all possible combination of the associated listed items. For example, each of the expressions "at least one of X, Y and Z," "at least one of X, Y or Z," "one or more of X, Y and Z," "one or more of X, Y or Z" and "X, Y and/or Z" can mean any of the following: 1) X, but not Y and not Z; 2) Y, but not X and not Z; 3) Z, but not X and not Y; 4) X and Y, but not Z; 5) X and Z, but not Y; 6) Y and Z, but not X; or 7) X, Y, and Z.

Additionally, unless expressly stated to the contrary, the terms "first," "second," "third," etc., are intended to distinguish the particular nouns they modify (e.g., element, condition, node, outlet, inlet, valve, module, activity, operation, etc.). Unless expressly stated to the contrary, the use of these terms is not intended to indicate any type of order, rank, importance, temporal sequence, or hierarchy of the modified noun. For example, "first X" and "second X" are intended to designate two "X" elements that are not necessarily limited by any order, rank, importance, temporal sequence, or hierarchy of the two elements. Further as referred to herein, "at least one of" and "one or more of" can be represented using the "(s)" nomenclature (e.g., one or more element(s)).

What is claims is:

1. A centrifugal impeller, comprising:

a body formed of a composite material, the composite material including fibers and a binder; and an anti-abrasion component forming part of the body, the anti-abrasion component including a mechanical coupler, the anti-abrasion component being held within the body via the mechanical coupler, the anti-abrasion component having a body portion and a coupling portion extending from the body portion, wherein:

the coupling portion includes a first surface, a second surface opposite to the first surface, a first side, a second side opposite to the first side, a first end, and a second end opposite to the first end, the first end is proximate the body portion, and a thickness dimension of the second end is larger than a thickness dimension of the first end, and the mechanical coupler includes a textured portion that is formed by several projections, one of the first surface, the second surface, the first side, and the second side includes the textured portion, and the projections are spaced apart from each other and from the first side and the second side.

2. The centrifugal impeller of claim 1, wherein the body has an end, and the anti-abrasion component is located at the end of the body.

3. The centrifugal impeller of claim 1, wherein the mechanical coupler includes at least one post extending from the coupling portion.

4. The centrifugal impeller of claim 1, wherein the mechanical coupler includes at least one hook extending from the coupling portion.

5. The centrifugal impeller of claim 1, wherein the body has a trailing edge and a leading edge, the anti-abrasion component is a first anti-abrasion component located at the trailing edge of the body, and the centrifugal impeller further comprises:

a second anti-abrasion component that is located at the leading edge of the body.

6. The centrifugal impeller of claim 1, wherein the first surface includes the textured portion, and the second surface includes another textured portion.

7. The centrifugal impeller of claim 6, wherein the projections extend from the first surface, and the second surface includes projections extending therefrom.

8. The centrifugal impeller of claim 7, wherein the projections are cylindrical posts.

9. A composite impeller for a centrifugal impeller, the composite impeller comprising:

a body including an end, the body being formed of a composite material including fibers and a binder; and an anti-abrasion component being coupled to the composite material and forming part of the body, the anti-abrasion component including a mechanical coupler, the anti-abrasion component being held within the body via the mechanical coupler, and the anti-abrasion component being located at the end of the body, the anti-abrasion component having a coupling portion including a first surface, an opposite second surface, a first side, an opposite second side, a first end, and an opposite second end, a thickness dimension of the second end is larger than a thickness dimension of the first end, and the coupling portion having a mechanical coupler that includes projections extending from one of the first surface, the second surface, the first side, and the second side, wherein the projections are spaced apart from each other and from the first side and the second side.

10. The composite impeller of claim 9, wherein the anti-abrasion component includes a body portion, the coupling portion extending from the body portion.

11. The composite impeller of claim 10, wherein the first end is proximate the body portion.

12. The composite impeller of claim 9, wherein the mechanical coupler includes at least one post extending from the coupling portion.

13. The composite impeller of claim 9, wherein the mechanical coupler includes at least one hook extending from the coupling portion.

14. The centrifugal impeller of claim 9, wherein the mechanical coupler includes a textured portion, the textured portion assisting with maintaining the anti-abrasion component in the body.

15. The composite impeller of claim 9, wherein the projections extend from the first surface and additional projections extend from the second surface.

16. The composite impeller of claim 15, wherein the projections are cylindrical posts.

17. A centrifugal impeller, comprising:

a body formed of a composite material including fibers and a binder; and an anti-abrasion component forming part of the body, the anti-abrasion component including a mechanical coupler that holds the anti-abrasion component within the body, the anti-abrasion component having a body portion and a coupling portion extending from the body portion, the coupling portion has a first surface, a second surface opposite to the first surface, a first end proximate to the body portion, and a second end opposite to the first end, a thickness dimension of the second end is larger than a thickness dimension of the first end, and the mechanical coupler includes a textured portion formed by several projections extending from one of the first surface or the second surface, wherein the projections are spaced apart from each other.

18. The centrifugal impeller of claim 17, wherein the body has an end, and the anti-abrasion component is located at the end of the body.

19. The centrifugal impeller of claim 18, wherein the projections extend from the first surface and from the second surface.

20. The centrifugal impeller of claim 17, wherein a width dimension of the body portion is the same as a width dimension of the coupling portion.

* * * * *